US008094116B2

(12) United States Patent
Sakai et al.

(10) Patent No.: US 8,094,116 B2
(45) Date of Patent: Jan. 10, 2012

(54) SERIAL-PARALLEL CONVERSION CIRCUIT, DISPLAY EMPLOYING IT, AND ITS DRIVE CIRCUIT

(75) Inventors: Tamotsu Sakai, Ikoma (JP); Tomoyuki Nagai, Nara (JP); Kazuhiro Maeda, Souraku-gun (JP); Shuji Nishi, Nara (JP); Masakazu Satoh, Sakurai (JP)

(73) Assignee: Sharp Kabsuhiki Kaisha, Osaka (JP)

( * ) Notice: Subject to any disclaimer, the term of this patent is extended or adjusted under 35 U.S.C. 154(b) by 1064 days.

(21) Appl. No.: 11/665,332

(22) PCT Filed: Sep. 9, 2005

(86) PCT No.: PCT/JP2005/016636

§ 371 (c)(1),
(2), (4) Date: Dec. 10, 2007

(87) PCT Pub. No.: WO2006/043374

PCT Pub. Date: Apr. 27, 2006

(65) Prior Publication Data

US 2011/0181556 A1 Jul. 28, 2011

(30) Foreign Application Priority Data

Oct. 18, 2004 (JP) ..... P2004-302453

(51) Int. Cl.
*G09G 3/36* (2006.01)

(52) U.S. Cl. ..... 345/100; 341/100

(58) Field of Classification Search ..... 345/100; 341/100

See application file for complete search history.

(56) References Cited

U.S. PATENT DOCUMENTS

| | | | | |
|---|---|---|---|---|
| 6,791,539 | B2 * | 9/2004 | Nakajima et al. | 345/204 |
| 7,116,292 | B2 * | 10/2006 | Ozawa | 345/76 |
| 2002/0030653 | A1 | 3/2002 | Cairns et al. | |
| 2005/0057547 | A1 * | 3/2005 | Iwabuchi et al. | 345/204 |
| 2006/0233035 | A1 * | 10/2006 | Ishikawa | 365/219 |

FOREIGN PATENT DOCUMENTS

| | | |
|---|---|---|
| JP | 05-061435 | 3/1993 |
| JP | 06-268522 | 9/1994 |
| JP | 2002-140053 | 5/2002 |

* cited by examiner

*Primary Examiner* — Richard Hjerpe
*Assistant Examiner* — Sahlu Okebato
(74) *Attorney, Agent, or Firm* — Harness, Dickey & Pierce, P.L.C.

(57) ABSTRACT

The present invention relates to a serial-parallel conversion circuit of a display device.
First latch circuits for sampling and latching a serial signal in accordance with sampling pulses outputted from a shift register (31) are provided in association with stages of the shift register (31). In addition, second latch circuits for latching signals outputted from the first latch circuits are provided in association with portions of the stages of the shift register (31). In this case, of all the stages of the shift register (31), the number of stages associated with the second latch circuits is less than the total number of stages of the shift register by two or more.

17 Claims, 12 Drawing Sheets

SERIAL-PARALLEL CONVERSION CIRCUIT, DISPLAY EMPLOYING IT, AND ITS DRIVE CIRCUIT

TECHNICAL FIELD

The present invention relates to a serial-parallel conversion circuit for converting, for example, externally transmitted serial-format data in a video signal line drive circuit of a display device into parallel-format data for display on a display unit.

BACKGROUND ART

Conventionally, source drivers (video signal line drive circuits) of liquid crystal display devices perform a process for converting digital image signals, which are externally transmitted in serial format, into parallel format in order to provide sufficient time for writing to (charging) each pixel capacitance. FIG. 9 is a block diagram illustrating the configuration of a source driver in a conventional liquid crystal display device having n video signal lines (hereinafter, referred to as the "first to n'th video signal lines SL1 to SLn"). The source driver includes a shift register 71, a No. 1 latch circuit group 72, a No. 2 latch circuit group 73, and an output circuit group 75. The shift register 71 includes n flip-flop circuits (hereinafter, referred to as the "first to n'th flip-flop circuits FF1 to FFn") associated with the first to n'th video signal lines SL1 to SLn, respectively. That is, the shift register 71 is composed of n stages. The No. 1 latch circuit group 72 includes n latch circuits (hereinafter, referred to as the "first to n'th No. 1 latch circuits Lf1 to Lfn") associated with the first to n'th video signal lines SL1 to SLn, respectively. The No. 2 latch circuit group 73 includes n latch circuits (hereinafter, referred to as the "first to n'th No. 2 latch circuits Ls1 to Lsn") associated with the first to n'th video signal lines SL1 to SLn, respectively. The output circuit group 75 includes n output circuits (hereinafter, referred to as the "first to n'th output circuits B1 to Bn") associated with the first to n'th video signal lines SL1 to SLn. In addition, each of the output circuits B1 to Bn includes a digital/analog conversion unit (not shown) and a buffer unit (not shown).

Inputted to the shift register 71 are a source start pulse signal SSP and a source clock signal SCK, and based on these signals SSP and SCK, the shift register 71 sequentially transfers each pulse included in the source start pulse signal SSP from the first flip-flop circuit FF1 to the n'th flip-flop circuit FFn. In response to the transfer, sampling pulses SO1 to SOn are sequentially outputted from their respective flip-flop circuits FF1 to FFn. The sampling pulses SO1 to SOn are respectively inputted to the first to n'th No. 1 latch circuits Lf1 to Lfn in the No. 1 latch circuit group 72. Also, a digital image signal Da outputted from a display control circuit 200 is inputted to each of the first to n'th No. 1 latch circuits Lf1 to Lfn. The digital image signals Da are sampled by the first to n'th No. 1 latch circuits Lf1 to Lfn, with the timings of the sampling pulses SO1 to SOn, respectively, and outputted as internal image signals (hereinafter, denoted by characters dLf1 to dLfn). The first to n'th No. 2 latch circuits Ls1 to Lsn respectively receive the internal image signals outputted from the first to n'th No. 1 latch circuits Lf1 to Lfn, and concurrently output the internal image signals in accordance with a transfer instruction signal TR outputted from the display control circuit 200 (hereinafter, the internal image signals outputted from the first to n'th No. 2 latch circuits Ls1 to Lsn are denoted by characters dLs1 to dLsn). The first to n'th output circuits B1 to Bn receive the internal image signals dLs1 to dLsn, respectively, and subject them to digital/analog conversion and impedance conversion before outputting them as drive video signals Out1 to Outn. The drive video signals Out1 to Outn are respectively outputted from output ends 39 to the first to n'th video signal lines SL1 to SLn.

FIG. 10 is a signal waveform diagram in relation to the above configuration. Character Ts denotes a cycle in which sampling pulses are outputted from the shift register 71 (a period corresponding to a pulse repetition cycle of the source clock signal SCK). Character Ta denotes a period corresponding to one horizontal scanning period. This corresponds to a pulse repetition cycle of the start pulse signal SSP. Character Tx denotes a period (hereinafter, also referred to as the "process period") in which writing to the pixel capacitance is performed. Character dTm denotes a period related to the writing to the pixel capacitance and required for switching from one horizontal line to the next horizontal line. Characters t11 to t28 denote time points (timings) for each pulse repetition cycle of the source clock signal SCK. Characters d11 to d1*n* each denote pixel data for a pixel included in the first horizontal line, and characters d21 to d2*n* each denote pixel data for a pixel included in the second horizontal line.

When a pulse of the source start pulse signal SSP is inputted to the shift register 71, the flip-flop circuits FF1 to FFn sequentially and respectively output the sampling pulses SO1 to SOn in order from the first flip-flop circuit FF1 to the n'th flip-flop circuit FFn, in accordance with a pulse of the source clock signal SCK. The first to n'th No. 1 latch circuits Lf1 to Lfn sample the externally transmitted image signals Da, respectively, with the timings of the sampling pulses SO1 to SOn as described above, and output the sampled image signals Da as the internal image signals dLf1 to dLfn. For example, when the time point t11 is reached, the first No. 1 latch circuit Lf1 receives the sampling pulse SO1, and samples the image signal Da. At this time, the image signal Da represents the pixel data d11 as shown in FIG. 10. Accordingly, in a period from the time point t11 until the time point t21 at which the first No. 1 latch circuit Lf1 receives the next sampling pulse SO1, the internal image signal dLf1 representing the pixel data d11 is outputted from the first No. 1 latch circuit Lf1. As for the second to n'th No. 1 latch circuits Lf2 to Lfn, similarly, in their respective periods from reception of the sampling pulses SO2 to SOn until reception of the next sampling pulses SO2 to SOn, the internal image signals dLf2 to dLfn respectively representing the pixel data d12 to d1*n* are outputted. The internal image signals dLf1 to dLfn are inputted to the first to n'th No. 2 latch circuits Ls1 to Lsn, respectively.

Thereafter, when the transfer instruction signal TR changes from low to high level, the first to n'th No. 2 latch circuits Ls1 to Lsn respectively output, as the internal image signals dLs1 to dLsn, the internal image signals dLf1 to dLfn representing the pixel data d11 to d1*n* transmitted from the first to n'th No. 1 latch circuits Lf1 to Lfn. As such, the internal image signals representing pixel data for pixels included in each horizontal line are concurrently outputted from the No. 2 latch circuit group 73, thereby ensuring a sufficient charge time for writing to each pixel capacitance.

FIG. 11 is a block diagram illustrating the configuration of a source driver of a display device disclosed in Japanese Laid-Open Patent Publication No. 2002-140053, and FIG. 12 is a signal waveform diagram in relation to that configuration. As shown in FIG. 11, the No. 2 latch circuit group 73 of the source driver does not include a No. 2 latch circuit associated with the n'th video signal line SLn. In addition, the sampling pulse SOn outputted from the n'th flip-flop circuit FFn is inputted to the No. 2 latch circuit group 73 as the transfer instruction signal TR. As a result, while the No. 2 latch circuits are reduced in number, a sufficient charge time for writing to each pixel capacitance is ensured.

[Patent Document 1] Japanese Laid-Open Patent Publication No. 2002-140053

DISCLOSURE OF THE INVENTION

Problems to be Solved by the Invention

The above display device disclosed in Japanese Laid-Open Patent Publication No. 2002-140053, however, makes it possible to eliminate only one No. 2 latch circuit. Accordingly, while it is possible to achieve the effect of eliminating the necessity of the external transfer instruction signal, it is not possible to achieve any satisfactory effect in terms of reduction in circuit scale. In particular, so-called monolithic-type display devices in which a drive circuit is formed on a substrate constituting a display panel have a critical problem of reducing the circuit scale to achieve low power consumption and compactness.

Therefore, the present invention aims to provide a serial-parallel conversion circuit that allows reduction in circuit scale without reducing display quality, thereby achieving low power consumption and compactness.

Means for Solving the Problems

A first aspect of the present invention is directed to a serial-parallel conversion circuit for converting a serial signal into a parallel signal for each predetermined period, the circuit comprising:

a shift register for sequentially outputting sampling pulses to sample the serial signal;

first latch circuits provided in association with stages of the shift register so as to sample and latch the serial signal in accordance with the sampling pulses; and second latch circuits provided in association with their respective portions of the stages of the shift register so as to latch signals outputted from the first latch circuits provided in association with the stages associated with the second latch circuits, and wherein the number of stages included in the portions of the stages is less than a total number of stages of the shift register by two or more.

A second aspect of the present invention is directed to a video signal line drive circuit of a display device including a plurality of pixel formation units for forming an image to be displayed and a plurality of video signal lines for conveying a plurality of video signals representing the image to the pixel formation units, wherein the video signal line drive circuit comprises a serial-parallel conversion circuit according to the first aspect.

In a third aspect of the present invention, based on the first aspect of the present invention, the following equation is satisfied:

$$N \leqq (M-2) \times L,$$

where the total number of stages of the shift register is M, the number of first latch circuits associated with the stages of the shift register is L, and a total number of second latch circuits is N.

In a fourth aspect of the present invention, based on the third aspect of the present invention, the number of second latch circuits are set, such that a period in which signal values of signals outputted from first latch circuits not associated with the second latch circuits are values of serial signals which are in the same predetermined period is longer than a state maintaining period, which is a period in which to maintain a value of the parallel signal.

In a fifth aspect of the present invention, based on the fourth aspect of the present invention, the following equation is satisfied:

$$Tx \leqq Ta - Ts \times (M - N/L - 1),$$

where the state maintaining period is Tx, a cycle in which the serial signal is converted into the parallel signal is Ta, and a cycle in which the sampling pulses are outputted from the shift register is Ts.

In a sixth aspect of the present invention, based on the first aspect of the present invention, switching circuits for selecting whether to allow or prevent conveyance of the parallel signal to their respective output ends are provided at least between first latch circuits not associated with the second latch circuits and the output ends, and the switching circuits allow the conveyance of the parallel signal to the output ends during the state maintaining period, but prevent the conveyance of the parallel signal to the output ends during periods other than the state maintaining period.

In a seventh aspect of the present invention, based on the first aspect of the present invention, switching circuits for selecting whether to allow or prevent conveyance of the parallel signal to their respective output ends are provided between the second latch circuits and the output ends and between first latch circuits not associated with the second latch circuits and the output ends, and the switching circuits allow the conveyance of the parallel signal to the output ends during the state maintaining period, but prevent the conveyance of the parallel signal to the output ends during periods other than the state maintaining period.

In an eighth aspect of the present invention, based on the first aspect of the present invention, an element constituting the serial-parallel conversion circuit is a thin-film transistor.

A ninth aspect of the present invention is directed to a display device comprising a plurality of pixel formation units for forming an image to be displayed, a plurality of video signal lines for conveying a plurality of video signals representing the image to the pixel formation units, and a video signal line drive circuit for driving the video signal lines, the video signal line drive circuit having a serial-parallel conversion circuit for converting a serial signal into a parallel signal for each predetermined period, wherein the serial-parallel conversion circuit includes:

a shift register for sequentially outputting sampling pulses to sample the serial signal;

first latch circuits provided in association with stages of the shift register so as to sample and latch the serial signal in accordance with the sampling pulses; and second latch circuits provided in association with their respective portions of the stages of the shift register so as to latch signals outputted from the first latch circuits provided in association with the stages associated with the second latch circuits, and wherein the number of stages included in the portions of the stages is less than a total number of stages of the shift register by two or more.

Advantages of the Invention

According to the first aspect of the present invention, the first latch circuits associated with portions of all the stages constituting the shift register that have their respective second latch circuits provided therein, and the second latch circuits operate as follows. Signals sequentially outputted from the first latch circuits are inputted to the second latch circuits from which signals constituting a part of the parallel signal are outputted. On the other hand, the first latch circuits associated with portions of all the stages constituting the shift register that do not have any second latch circuit operate so as to output therefrom signals constituting a part of the parallel signal. In this case, of all the stages of the shift register, the number of stages that have their respective second latch circuits provided therein may be less than the number of stages of the shift register by two or more. Thus, it is possible to reduce circuit scale compared to the conventional art, because conventionally, it has been necessary to provide the second latch circuits in association with all the stages of the shift register or all the stages excluding one stage.

According to the second aspect of the present invention, it is possible to reduce circuit scale of the video signal line drive circuit in the display device compared to the conventional art, while maintaining the output of the parallel signal for a relatively long period. Thus, comparing to the conventional art, it is possible to enhance yield and achieve low power consumption and compactness of the device.

According to the third aspect of the present invention, when a plurality of first latch circuits are provided in association with the stages of the shift register, the number of second latch circuits to be provided may be less than the product of a number obtained by subtracting two from the number of stages of the shift register and the number of first latch circuits provided in association with the stages of the shift register. Thus, as in the first invention, it is possible to reduce the circuit scale compared to the conventional art.

According to the fourth invention, the number of second latch circuits are determined, such that the period in which signal values of the signals outputted from the first latch circuits not associated with the second latch circuits are values of serial signals in the same predetermined period is longer than the period in which to maintain the parallel signal. Thus, it is possible to reliably convert the serial signal into the parallel signal by the serial-parallel conversion circuit with a reduced circuit scale compared to the conventional art.

According to the fifth invention, at least during the period in which to maintain the output of the parallel signal, the signal value of the signal that is being outputted is maintained at the value of the serial signal in the same predetermined period. Thus, it is possible to convert the serial signal into the parallel signal by the serial-parallel conversion circuit with a reduced circuit scale compared to the conventional art, such that a valid parallel signal is outputted during the period in which to maintain the output of the parallel signal.

According to the sixth invention, during the period in which to maintain the output of the parallel signal, the parallel signal is outputted to the outside at least from the first latch circuit not associated with the second latch circuits, and the output to the outside during other periods is placed in high-impedance state. Accordingly, in the case of applying the present invention to a display device, for example, it is possible to prevent unsatisfactory display from occurring due to switching of data contents. Thus, it is possible to enhance display quality.

According to the seventh invention, during the period in which to maintain the output of the parallel signal, the parallel signal is outputted to the outside, and during other periods, the output to the outside is placed in high-impedance state. Accordingly, in the case of applying the present invention to a display device, it is possible to prevent unsatisfactory display from occurring due to switching of data contents, as in the sixth invention, whereby it is possible to enhance display quality.

According to the eighth invention, the element constituting the serial-parallel conversion circuit is a thin-film transistor. Thus, in the case of applying the present invention to a liquid crystal display device, for example, it is possible to integrally form the serial-parallel conversion circuit with a display panel.

According to the ninth aspect of the present invention, it is possible to reduce circuit scale of the video signal line drive circuit in the display device compared to the conventional art, while maintaining the output of the parallel signal for a relatively long period. Thus, comparing to the conventional art, it is possible to enhance yield and achieve low power consumption and compactness of the device.

LEGEND

Figure 1:
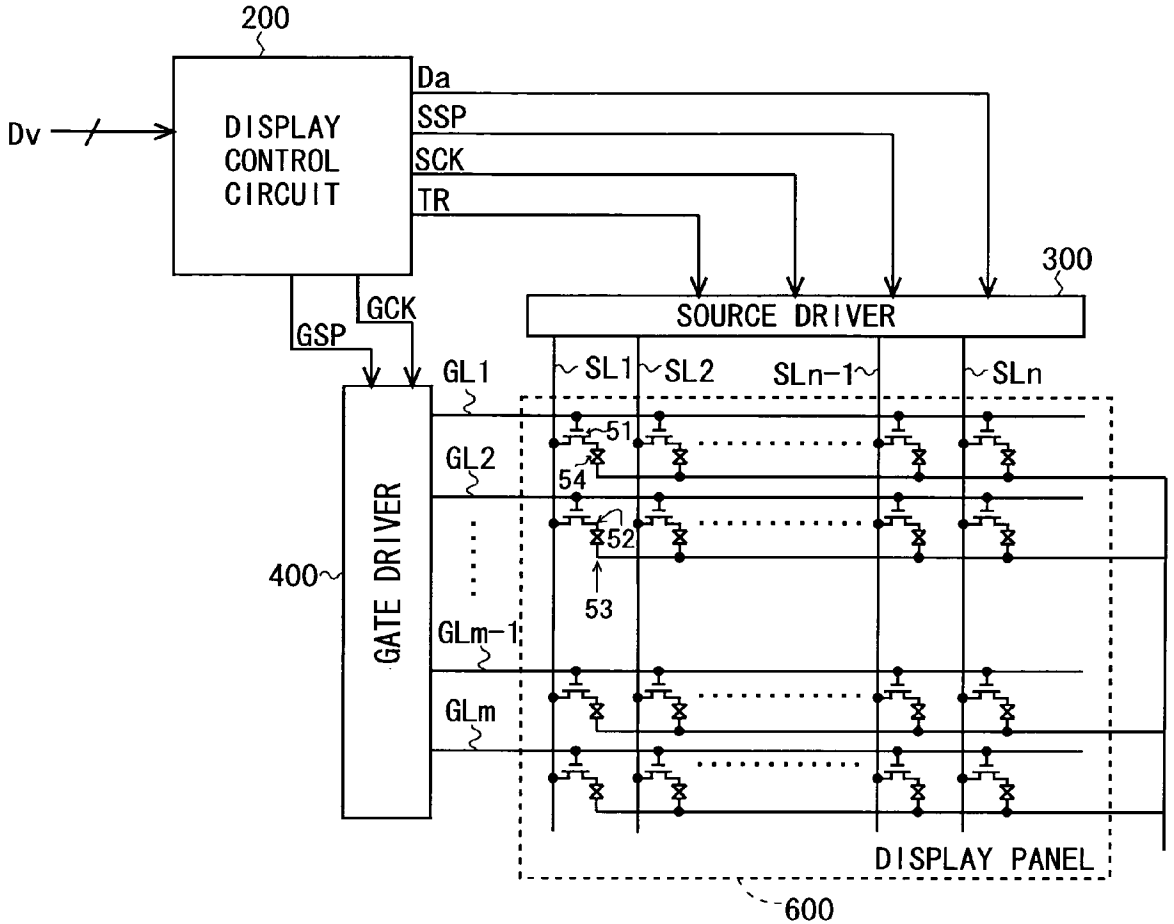
FIG. 1 is a block diagram illustrating the overall configuration of an active matrix-type liquid crystal display device according to an embodiment of the present invention.

31 . . . shift register
32 . . . No. 1 latch circuit group
33 . . . No. 2 latch circuit group
35 . . . output circuit group
200 . . . display control circuit
300 . . . source driver (video signal line drive circuit)
400 . . . gate driver (scanning signal line drive circuit)
600 . . . display panel
Lf1 to Lfn . . . No. 1 latch circuits
Ls1 to Lsn . . . No. 2 latch circuits
TR . . . transfer instruction signal

BEST MODE FOR CARRYING OUT THE INVENTION

Hereinafter, an embodiment of the present invention will be described with reference to the accompanying drawings.

<1. Overall Configuration and Operation>

FIG. 1 is a block diagram illustrating the overall configuration of an active matrix-type liquid crystal display device according to an embodiment of the present invention. The liquid crystal display device includes a display control circuit 200, a source driver (video signal line drive circuit) 300, a gate driver (scanning signal line drive circuit) 400, and a display panel 600. A so-called monolithic-type configuration is taken in which the source driver 300 and the gate driver 400 are formed on a substrate constituting the display panel 600. In the display panel 600, a plurality of scanning signal lines GL1 to GLm and a plurality of video signal lines SL1 to SLn are provided in the form of a matrix, and a pixel formation unit is provided at each intersection of the scanning signal lines and the video signal lines. Each pixel formation unit includes: a TFT 51 as a switching element; a pixel electrode 52 connected to the TFT 51; a common electrode 53 provided commonly for each pixel formation unit; a liquid crystal layer sandwiched between the pixel electrode 52 and the common electrode 53; and a charge holding capacitance (not shown) formed in parallel with a liquid crystal capacitance 54 formed by the pixel electrode 52 and the common electrode 53. The liquid crystal capacitance and the charge holding capacitance constitute a pixel capacitance in which a voltage reflecting a pixel value is held. The scanning signal lines GL1 to GLm are connected to the gate driver 400, and the video signal lines SL1 to SLn are connected to the source driver 300. Note that for ease of explanation, the following description will be given on the assumption that there are six video signal lines (hereinafter, referred to as the "first to sixth video signal lines SL1 to SL6").

The display control circuit 200 receives externally transmitted image data Dv, and outputs a digital image signal Da, and, for controlling the timing of displaying, outputs a source start pulse signal SSP an image on the display panel 600, a source clock signal SCK, a transfer instruction signal TR, a gate start pulse signal GSP, and a gate clock signal GCK. The source driver 300 receives the digital image signal Da, the source start pulse signal SSP, the source clock signal SCK and the transfer instruction signal TR, which are outputted from the display control circuit 200, and applies a drive video signal to each of the video signal lines SL1 to SL6 to drive the display panel 600. In order to sequentially select each of the scanning signal lines GL1 to GLm for each horizontal scanning period, the gate driver 400 repeatedly applies an active scanning signal to each scanning signal line with one vertical scanning period being used as a cycle, based on the gate start pulse signal GSP and the gate clock signal GCK outputted from the display control circuit 200.

<2. Configuration and Operation of the Source Driver>

Figure 2:
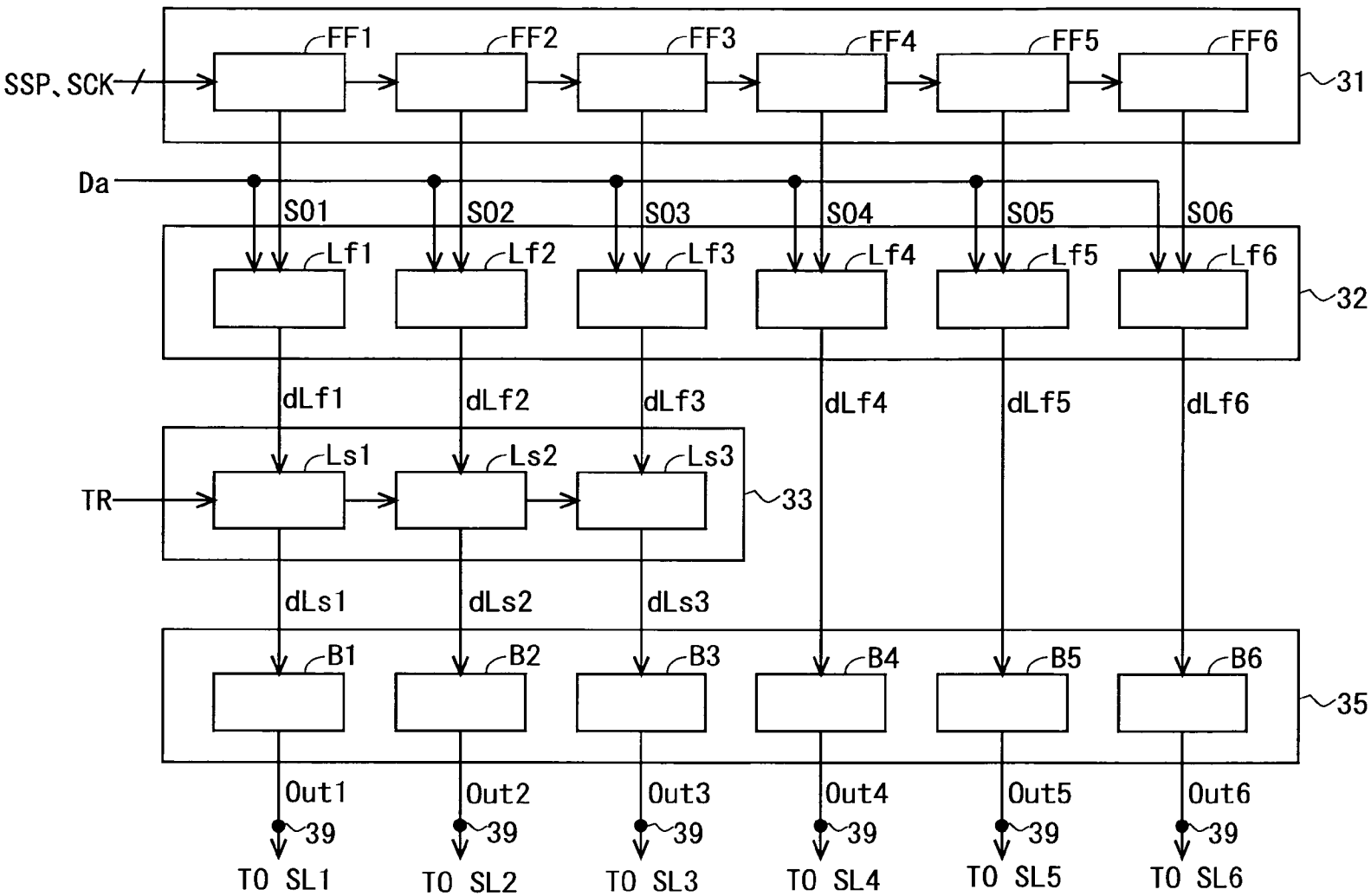
FIG. 2 is a block diagram illustrating the configuration of a source driver in the embodiment.

FIG. 2 is a block diagram illustrating the configuration of the source driver 300 in the present embodiment. The source driver 300 includes a shift register 31, a No. 1 latch circuit group (first latch circuit group) 32, a No. 2 latch circuit group (second latch circuit group) 33, and an output circuit group 35. The shift register 31 includes six flip-flop circuits (hereinafter, referred to as the "first to sixth flip-flop circuits FF1 to FF6") associated with the first to sixth video signal lines SL1 to SL6, respectively. That is, the shift register 31 is composed of six stages. The No. 1 latch circuit group 32 includes six latch circuits (hereinafter, referred to as the "first to sixth No. 1 latch circuits Lf1 to Lf6") associated with the first to sixth video signal lines SL1 to SL6, respectively. The No. 2 latch circuit group 33 includes three latch circuits (hereinafter, referred to as the "first to third No. 2 latch circuits Ls1 to Ls3") associated with the first to third video signal lines SL1 to SL3, respectively. The output circuit group 35 includes six output circuits (hereinafter, referred to as the "first to sixth output circuits B1 to B6") associated with the first to sixth video signal lines SL1 to SL6, respectively. In addition, each of the output circuits B1 to B6 includes a digital/analog conversion unit (not shown) and a buffer unit (not shown). The No. 2 latch circuit group 33 includes no latch circuits associated with the fourth to sixth video signal lines SL4 to SL6. As such, while the No. 1 latch circuits are provided in association with all the stages of the shift register 31, the No. 2 latch circuits are provided in association with only portions of all the stages of the shift register 31. Note that in the present description, a circuit having a function of latching a 1-bit signal is referred to as the "latch", a circuit for latching a signal composed of a plurality of bits by a sampling pulse is referred to as the "latch circuit", and a plurality of latch circuits arranged in parallel for generating parallel signals are referred to as the "latch circuit group".

Inputted to the shift register 31 are the source start pulse signal SSP and the source clock signal SCK, and based on these signals SSP and SCK, the shift register 31 sequentially transfers each pulse included in the start pulse signal SSP from the first flip-flop circuit FF1 to the sixth flip-flop circuit FF6. In response to the transfer, the flip-flop circuits FF1 to FF6 sequentially output sampling pulses SO1 to SO6, respectively. These sampling pulses SO1 to SO6 are inputted to the first to sixth No. 1 latch circuits Lf1 to Lf6, respectively, of the No. 1 latch circuit group 32. Also, the digital image signal Da outputted from the display control circuit 200 is inputted to each of the first to sixth No. 1 latch circuits Lf1 to Lf6. The digital image signals Da are sampled by the first to sixth No. 1 latch circuits Lf1 to Lf6, with the timings of the sampling pulses SO1 to SO6, respectively, and outputted as internal image signals (hereinafter, denoted by characters dLf1 to dLf6). The first to third No. 2 latch circuits Ls1 to Ls3 respectively receive the internal image signals dLf1 to dLf3 respectively outputted from the first to third No. 1 latch circuits Lf1 to Lf3, and concurrently output the internal image signals in accordance with the transfer instruction signal TR outputted from the display control circuit 200 (hereinafter, the internal image signals outputted from the first to third No. 2 latch circuits Ls1 to Ls3 are denoted by characters dLs1 to dLs3, respectively). The first to sixth output circuits B1 to B6 receive their respective internal image signals, and subject them to digital/analog conversion and impedance conversion before outputting them as drive video signals Out1 to Out6. The drive video signals Out1 to Out6 are respectively outputted from output ends 39 to the first to sixth video signal lines SL1 to SL6.

Figure 3:
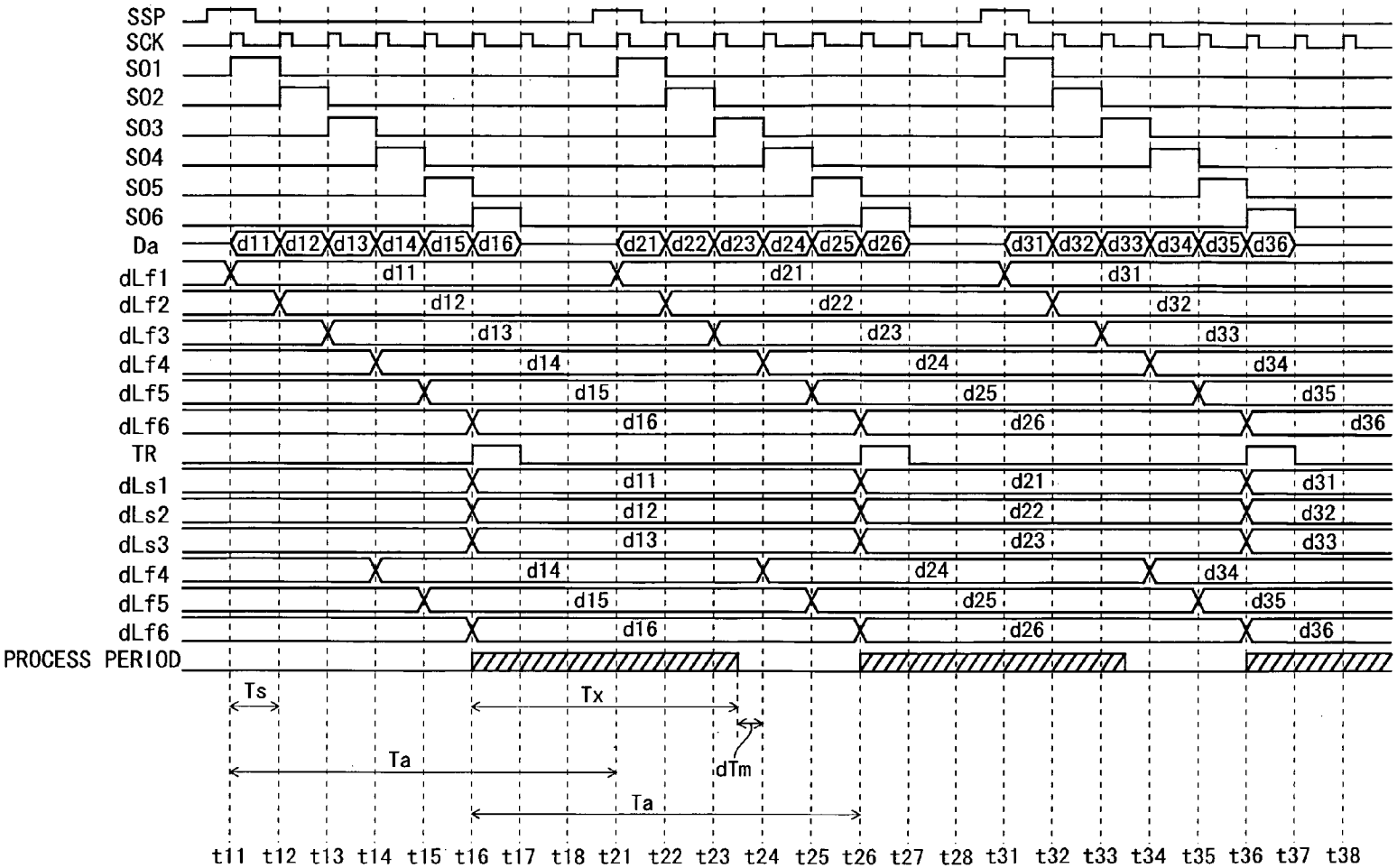
FIG. 3 is a signal waveform diagram in the embodiment.

FIG. 3 is a signal waveform diagram in the present embodiment. Character Ts denotes a cycle in which sampling pulses are outputted from the shift register 31 (a period corresponding to a pulse repetition cycle of the source clock signal SCK). Character Ta denotes a period corresponding to one horizontal scanning period. This corresponds to a pulse repetition cycle of the start pulse signal SSP. Character Tx denotes a period (hereinafter, also referred to as the "process period") in which writing to the pixel capacitance is performed. Character dTm denotes a period related to the writing to the pixel capacitance and required for switching from one horizontal line to the next horizontal line. Characters t11 to t38 denote time points (timings) for each pulse repetition cycle of the source clock signal SCK. Characters d11 to d16 each denote pixel data for a pixel included in the first horizontal line, characters d21 to d26 each denote pixel data for a pixel included in the second horizontal line, and characters d31 to d36 each denote pixel data for a pixel included in the third horizontal line. Also, in the present embodiment, the length of the period Ta corresponds to eight times the length of the period Ts. Note that in FIG. 3, for convenience of explanation, two waveforms are shown for each of the internal image signals dLf4 to dLf6.

When a pulse of the source start pulse signal SSP is inputted to the shift register 31, the flip-flop circuits FF1 to FF6 sequentially and respectively output the sampling pulses SO1 to SO6 in order from the first flip-flop circuit FF1 to the sixth flip-flop circuit FF6, in accordance with the pulse of the source clock signal SCK. The first to sixth No. 1 latch circuits Lf1 to Lf6 sample the externally transmitted image signals Da, respectively, with the above-described timings of the sampling pulses SO1 to SO6, and output the sampled image signals Da as the internal image signals dLf1 to dLf6. For example, when the time point t11 is reached, the first No. 1 latch circuit Lf1 receives the sampling pulse SO1, and samples the image signal Da. At this time, the image signal Da designates the pixel data d11 as shown in FIG. 3. Accordingly, in a period from the time point t11 until the time point t21 at which the first No. 1 latch circuit Lf1 receives the next sampling pulse SO1, the internal image signal dLf1 designating the pixel data d11 is outputted from the first No. 1 latch circuit Lf1. As for the second to sixth No. 1 latch circuits Lf2 to Lf6, similarly, in periods from reception of the sampling pulses SO2 to SO6 until reception of the next sampling pulses SO2 to SO6, the internal image signals dLf2 to dLf6 respectively designating pixel data d12 to d16 are outputted.

Of the above-described internal image signals dLf1 to dLf6, the internal image signals dLf1 to dLf3 respectively outputted from the first to third No. 1 latch circuits Lf1 to Lf3 are inputted to the first to third No. 2 latch circuits Ls1 to Ls3, respectively. On the other hand, the internal image signals dLf4 to dLf6 respectively outputted from the fourth to sixth No. 1 latch circuits Lf4 to Lf6 are inputted to the fourth to sixth output circuits B4 to B6, respectively.

When the transfer instruction signal TR changes from low to high level at the time point t16, the first to third No. 2 latch circuits Ls1 to Ls3 output, as internal image signals dLs1 to dLs3, the internal image signals dLf1 to dLf3 respectively transmitted from the first to third No. 1 latch circuits Lf1 to Lf3 and designating pixel data d11 to d13. The internal image signals dLs1 to dLs3 respectively designating the pixel data d11 to d13 are respectively outputted from the first to third No. 2 latch circuits Ls1 to Ls3 in a period from the time point t16 until the next time the transfer instruction signal TR changes from low to high level at the time point t26. In addition, the time point t16, at which the transfer instruction signal TR changes from low to high level, comes after the time points t11 to t13, at which the first to third No. 1 latch circuits Lf1 to Lf3 receive the sampling pulses SO1 to SO3, but before the timing of reception of the next sampling pulses SO1 to SO3. The internal image signals dLs1 to dLs3 respectively outputted from the first to third No. 2 latch circuits Ls1 to Ls3 are inputted to the first to third output circuits B1 to B3, respectively. Note that the timing for the transfer instruction signal TR to change from low to high level is the same as the timing for the sampling pulse SO6 to be inputted to the sixth No. 1 latch circuit Lf6.

As such, the internal image signals dLs1 to dLs3 and dLf4 to dLf6 inputted to the first to sixth output circuits B1 to B6 are respectively outputted as the drive video signals Out1 to Out6 from their respective output ends 39 to the video signal lines SL1 to SL6.

Now, to look at the period in which the internal image signals dLs1 to dLf6 respectively designating the pixel data d11 to d16 are inputted to the first to sixth output circuits B1 to B6, respectively. The internal image signals dLs1 to dLs3 and dLf6 respectively designating the pixel data d11 to d13 and d16 are inputted to the first to third output circuits B1 to B3 and the sixth output circuit B6, respectively, in a period from the time point t16 until the time point t26. The internal image signal dLS4 designating the pixel data d14 is inputted to the fourth output circuit B4 in a period from the time point t14 to the time point t24. The internal image signal dLs5 designating the pixel data d15 is inputted to the fifth output circuit B5 in a period from the time point t15 to the time point t25. Therefore, during the period from the time point t16 to the time point t24, any internal image signal designating pixel data other than the pixel data d11 to d16 are not inputted to the output circuit group 35, and therefore it is possible to perform a writing process for pixels included in the first horizontal line. Note that for writing to the pixel capacitance, the period dTm is required for switching horizontal lines on which the writing is performed, and therefore the process period lasts for a period denoted by character Tx in FIG. 3.

<3. Effect>

According to the above embodiment, as described above, the number of No. 2 latch circuits included in the No. 2 latch circuit group 33 within the source driver 300 is reduced from the number of conventionally used No. 2 latch circuits. The No. 1 latch circuits Lf1 to Lf3, the No. 2 latch circuits Ls1 to Ls3, and the output circuits B1 to B3, which are associated with stages having the No. 2 latch circuit provided therein among all the stages constituting the shift register 31 operate as follows. Specifically, after the internal image signals dLf1 to dLf3 sequentially outputted from the No. 1 latch circuits Lf1 to Lf3 are inputted to the No. 2 latch circuit Ls1 to Ls3, respectively, the internal image signals are concurrently outputted from the No. 2 latch circuit Ls1 to Ls3 in accordance with the transfer instruction signal TR, respectively, and in turn inputted to the output circuits B1 to B3.

On the other hand, the No. 1 latch circuits Lf4 to Lf6 and the output circuits B4 to B6, which are associated with stages not having any No. 2 latch circuit provided therein, operate as follows. Specifically, the internal image signals dLf4 to dLf6 sequentially outputted from the No. 1 latch circuits Lf4 to Lf6 are sequentially inputted to the output circuits B4 to B6, respectively. In this case, the transfer instruction signal TR is externally inputted, such that the timing of the completion of the inputting of all the internal image signals dLf4 to dLf6, which are sequentially outputted from the No. 1 latch circuits Lf4 to Lf6 associated with the stages not having any No. 2 latch circuit provided therein and sequentially and respectively inputted to the output circuits B4 to B6, to the output circuits B4 to B6, respectively, is equal to the timing for the internal image signals dLs1 to dLs3, which are concurrently outputted from the No. 2 latch circuits Ls1 to Ls3, to be inputted to the output circuits B1 to B3, respectively. Therefore, the drive video signals Out1 to Out6, whose states at predetermined time points are maintained, are outputted to the video signal lines SL1 to SL6, respectively, for a period sufficient for writing to the pixel capacitance.

In this manner, the display device can be reduced in terms of circuit scale, and therefore it is possible to enhance yield and reduce power consumption and device size.

Note that in the above embodiment, three No. 2 latch circuits are provided for six stage shift registers, but the present invention is not limited to this. Of all the stages of the shift register, the stages having their respective associated No. 2 latch circuits can be provided so as to be less in number than all the stages of the shift registers by two or more. In addition, when the number of stages of the shift registers is M, the number of No. 1 latch circuits each associated with one stage of the shift register is L, and the number of No. 2 latch circuits included in the No. 2 latch circuit group 33 is N, the following equation may be satisfied.

$$N \leqq (M-2) \times L$$

Furthermore, in the above embodiment, the output circuits for converting digital signals into analog signals are provided, but the present invention is not limited to this. In the case of outputting parallel signals in a digital signal format, it is not necessary to include the output circuits.

<4. First Variant>

Figure 4:
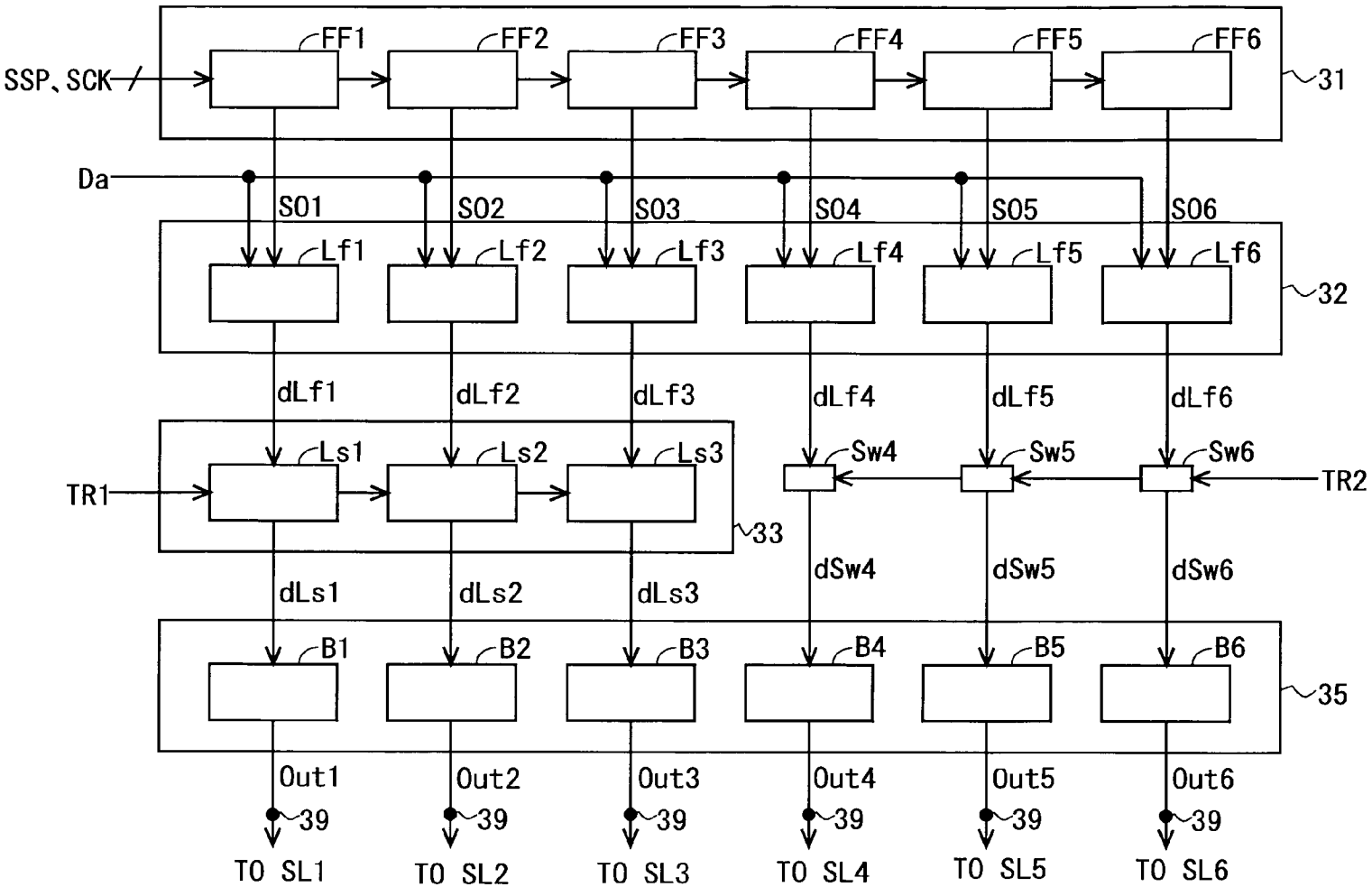
FIG. 4 is a block diagram illustrating the configuration of a source driver according to a first variant of the embodiment.

FIG. 4 is a block diagram illustrating the configuration of a source driver 300 according to a first variant of the above embodiment. In this variant, switches Sw4 to Sw6 are provided between the fourth to sixth No. 1 latch circuits Lf4 to Lf6 and the fourth to sixth output circuits B4 to B6. Inputted to the switches Sw4 to Sw6 is a transfer instruction signal transmitted from the display control circuit 200. Since other features are similar to those of the above embodiment, the same elements are denoted by the same characters, and detailed descriptions thereof will be omitted. Note that hereinafter, the transfer instruction signal inputted to the No. 2 latch group 33 is referred to as the "first transfer instruction signal TR1", and the transfer instruction signal inputted to the switches Sw4 to Sw6 is referred to as the "second transfer instruction signal TR2".

The switches Sw4 to Sw6 respectively receive internal image signals dLf4 to dLf6 respectively outputted from the fourth to sixth No. 1 latch circuits Lf4 to Lf6, and output the received internal image signals dLf4 to dLf6 as internal image signals dSw4 to dSw6 only in a period in which the second transfer instruction signal TR2 is placed at high level. These internal image signals dSw4 to dSw6 are inputted to the fourth to sixth output circuits B4 to B6, respectively.

Figure 5:
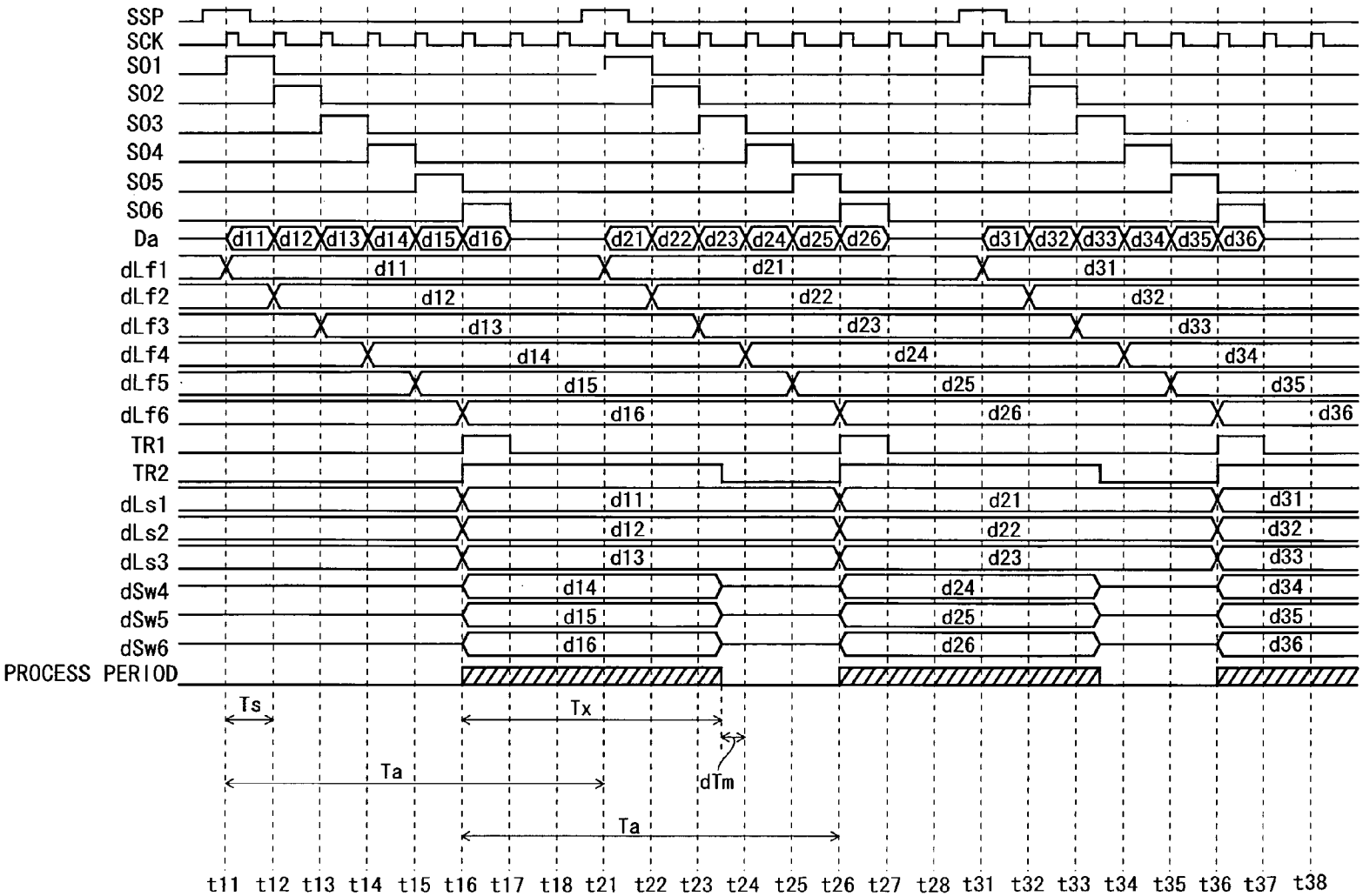
FIG. 5 is a signal waveform diagram in the first variant.

FIG. 5 is a signal waveform diagram in the present variant. As shown in FIG. 5, the second transfer instruction signal TR2 is placed at high level only in a period corresponding to the process period Tx, so that the internal image signals dSw4 to dSw6 are inputted to the fourth to sixth output circuits B4 to B6, respectively, only in that period. Now, to look at a period (one horizontal scanning period) from the time point t16 to the time point t26. In the above embodiment, in this period, the internal image signals designating the pixel data d24 and d25 other than the pixel data d11 to d16 are inputted to the output circuit group 35, as shown in FIG. 3. In such a case, a process for writing to the pixel capacitance might not be correctly performed, resulting in unsatisfactory image display. In the present variant, on the other hand, the internal image signals designating pixel data other than the pixel data d11 to d16 are not inputted to the output circuit group 35 in the period from the time point t16 to the time point t26, as shown in FIG. 5.

Note that in the present variant, three No. 2 latch circuits and three switches are provided for six shift registers, but the present invention is not limited to this, so long as switches are provided at least between the No. 1 latch circuits not having any associated No. 2 latch circuit among all the stages of the shift register and their respective output ends.

<5. Second Variant>

Figure 6:
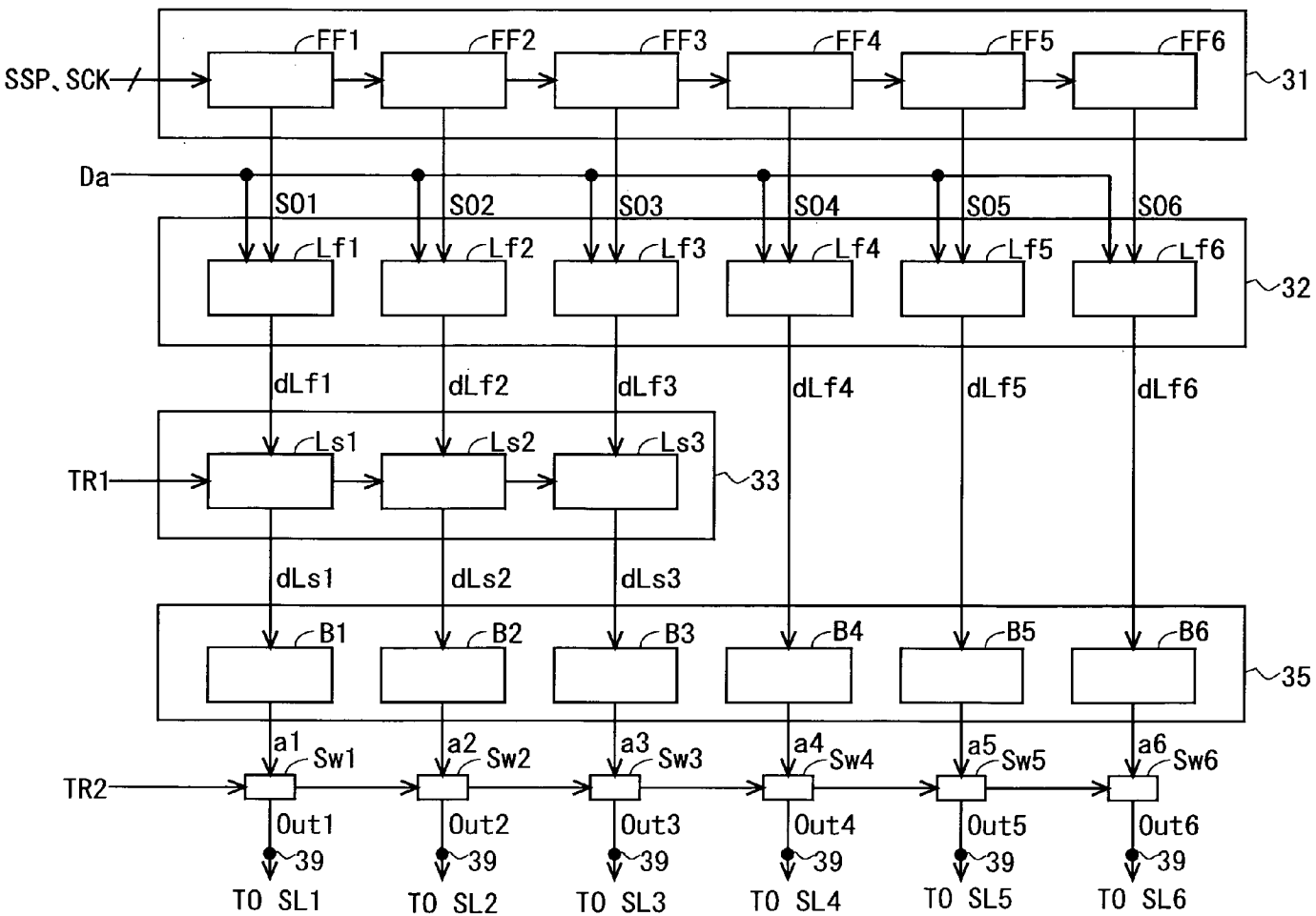
FIG. 6 is a block diagram illustrating the configuration of a source driver according to a second variant of the embodiment.

FIG. 6 is a block diagram illustrating the configuration of a source driver 300 according to a second variant of the above embodiment. In this variant, switches Sw1 to Sw6 are provided between the first to sixth output circuits B1 to B6 and the output ends 39 respectively associated with the output circuits B1 to B6. Inputted to these switches Sw1 to Sw6 is a transfer instruction signal transmitted from the display control circuit 200. Since other features are similar to those of the above embodiment, the same elements are denoted by the same reference characters, and detailed descriptions thereof will be omitted. Note that hereinafter, the transfer instruction signal inputted to the No. 2 latch group 33 is referred to as the "first transfer instruction signal TR1", and the transfer instruction signal inputted to the switches Sw1 to Sw6 is referred to as the "second transfer instruction signal TR2".

The switches Sw1 to Sw6 respectively receive internal image signals a1 to a6, which are respectively outputted from the first to sixth output circuits B1 to B6 after converted to analog signals, and output the received internal image signals a1 to a6 as drive video signals Out1 to Out6 only in a period in which the second transfer instruction signal TR2 is placed at high level. Note that in a period in which the second transfer instruction signal TR2 is placed at low level, the outputs from the switches Sw1 to Sw6 are placed in high-impedance state so as to maintain their states before the second transfer instruction signal TR2 is placed at low level.

Figure 7:
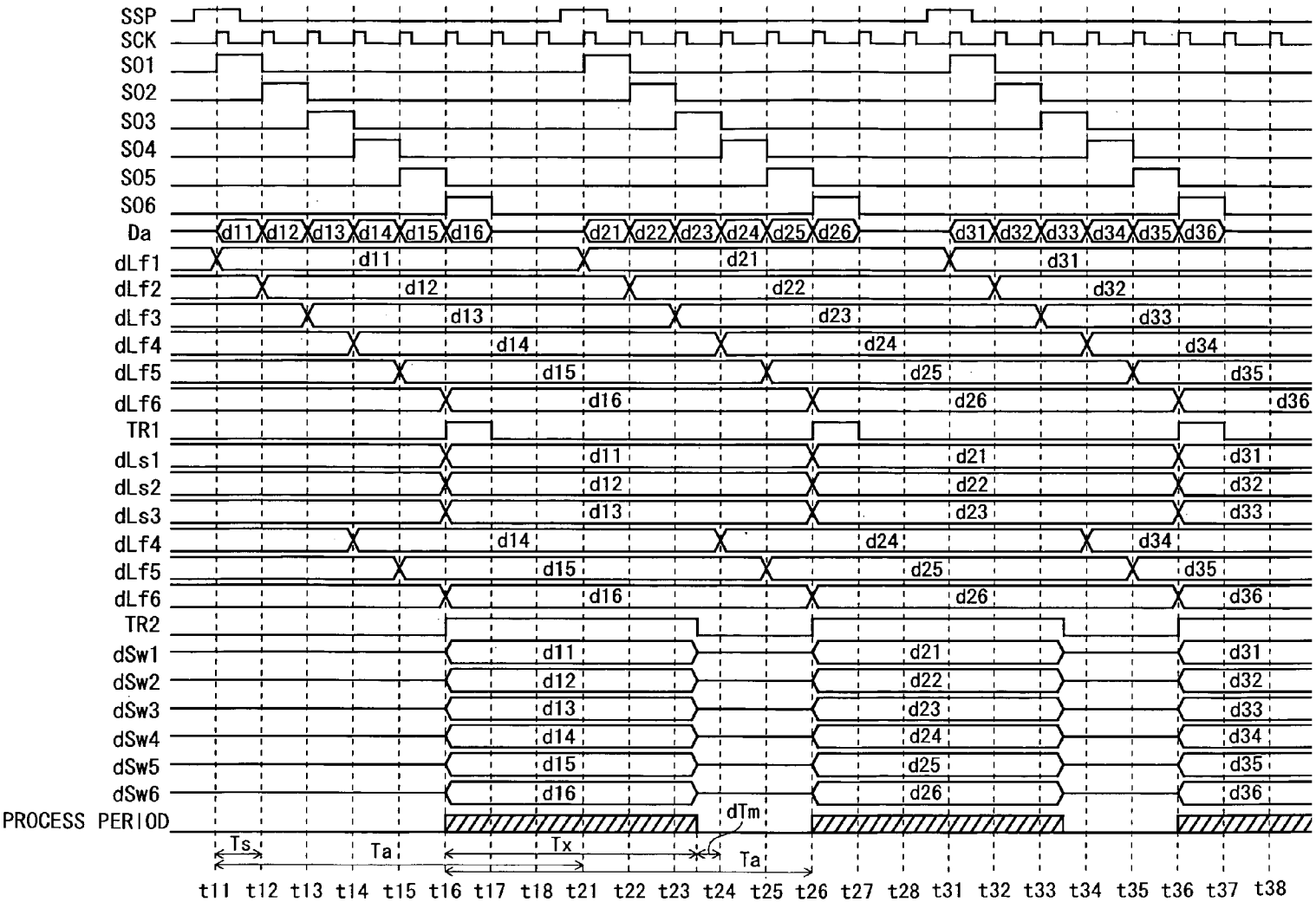
FIG. 7 is a signal waveform diagram in the second variant.

FIG. 7 is a signal waveform diagram in the present variant. As shown in FIG. 7, the second transfer instruction signal TR2 is placed at high level only in a period corresponding to the process period Tx, so that the drive video signals Out1 to Out6 are respectively conveyed from the first to sixth output circuits B1 to B6 to their respective output ends 39 in that period, and outputted to the first to sixth video signal lines SL1 to SL6 from the output ends 39. Now, look at the period (one horizontal scanning period) from the time point t16 to the time point t26. In the above embodiment and the first variant, the internal image signals are inputted to the output circuit group 35 in periods other than the process period Tx within that period, and the drive video signals are outputted to the video signal lines based on the internal image signals. In the present variant, on the other hand, the drive video signals are not outputted to the video signal lines in periods other than the process period Tx within the period from the time point t16 to the time point t26, as shown in FIG. 7. In addition, as described above, in each period other than the process period Tx, the drive video signals maintain their respective states before that period is reached. Accordingly, it is possible to efficiently prevent unsatisfactory display from occurring due to switching of data contents. Thus, it is possible to achieve the effect of enhancing display quality compared to the above embodiment and the first variant.

Note that in the present variant, six switches are provided for the six-stage shift register, but the present invention is not limited to this, so long as switches are provided between all the No. 1 latch circuits and their associated output ends.

<6. Example of Applying the Present Invention to a Color Liquid Crystal Display Device>

Figure 8:
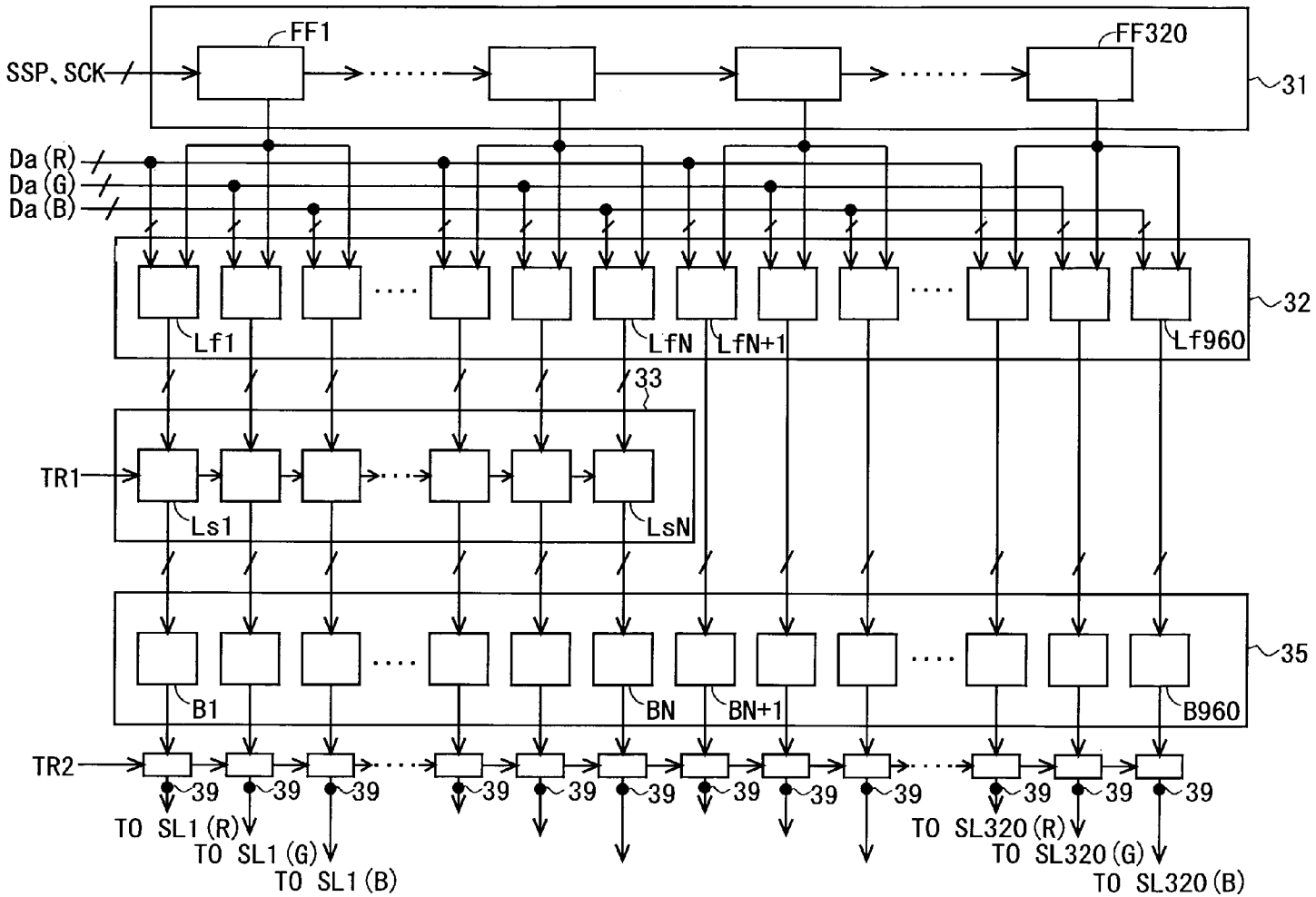
FIG. 8 is a block diagram illustrating the configuration of a source driver used in the case of applying the present invention to a color liquid crystal display device.
Figure 9:
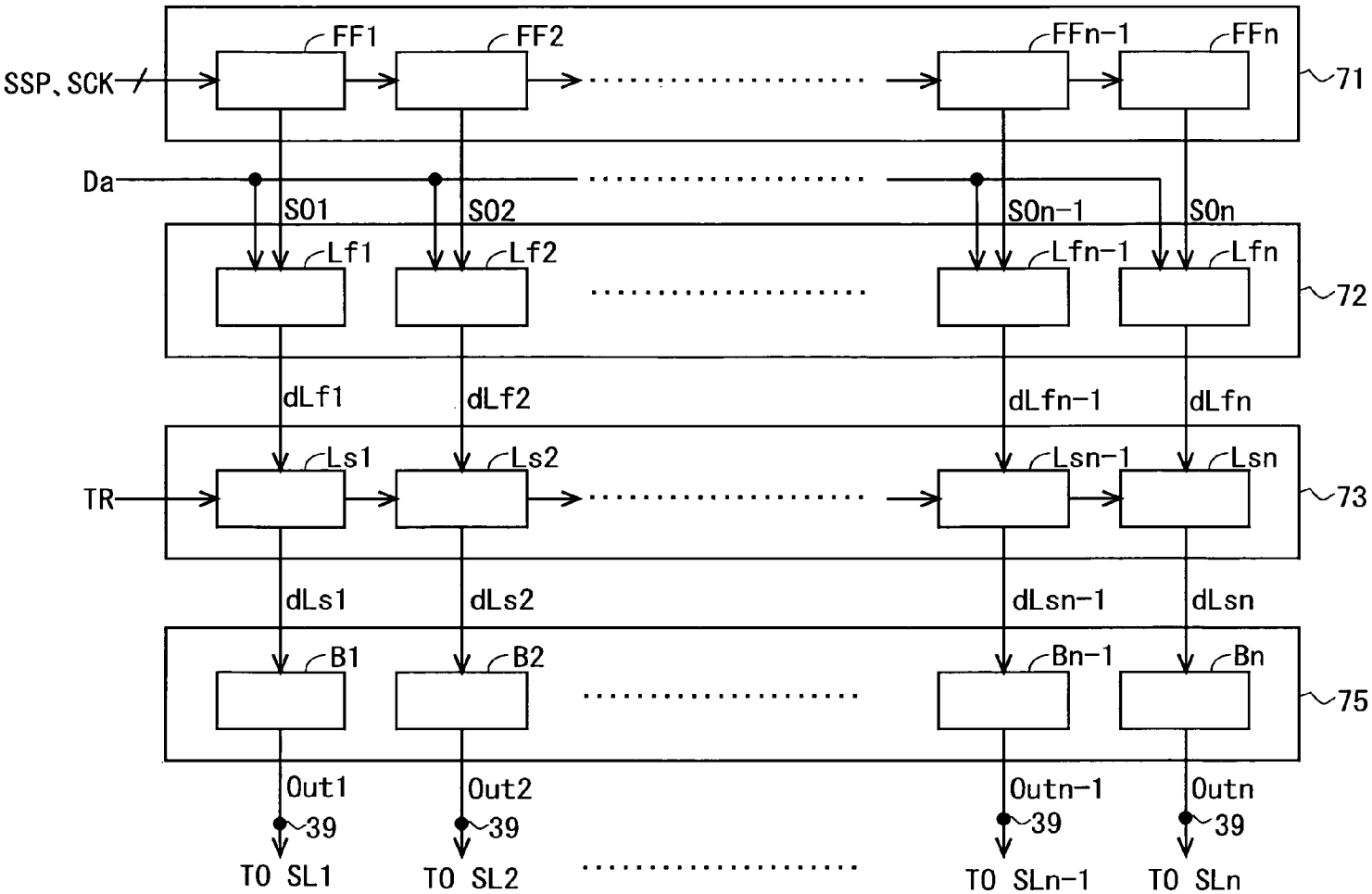
FIG. 9 is a block diagram illustrating the configuration of a source driver according to the conventional art.
Figure 10:
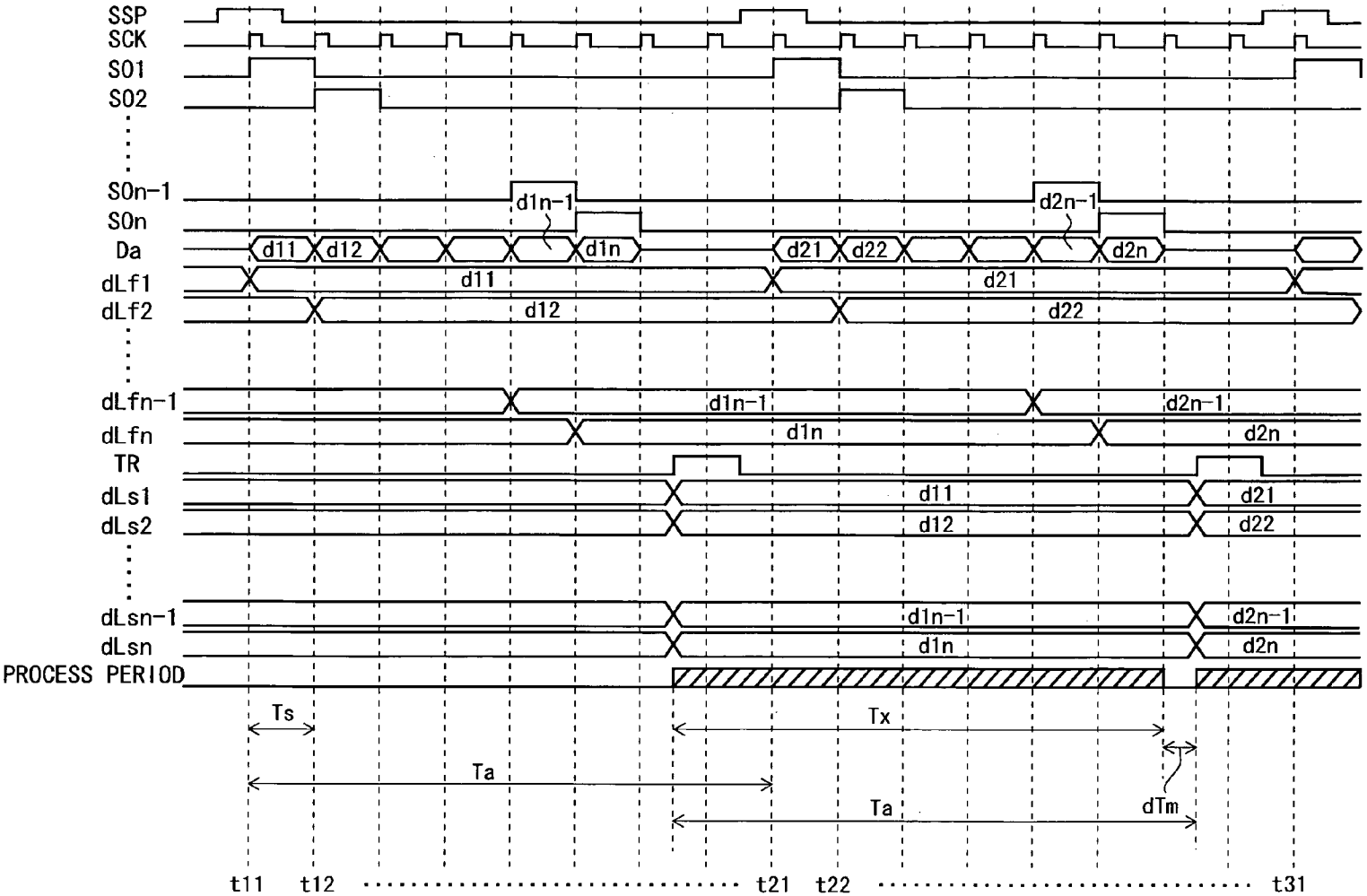
FIG. 10 is a signal waveform diagram in relation to the conventional art.
Figure 11:
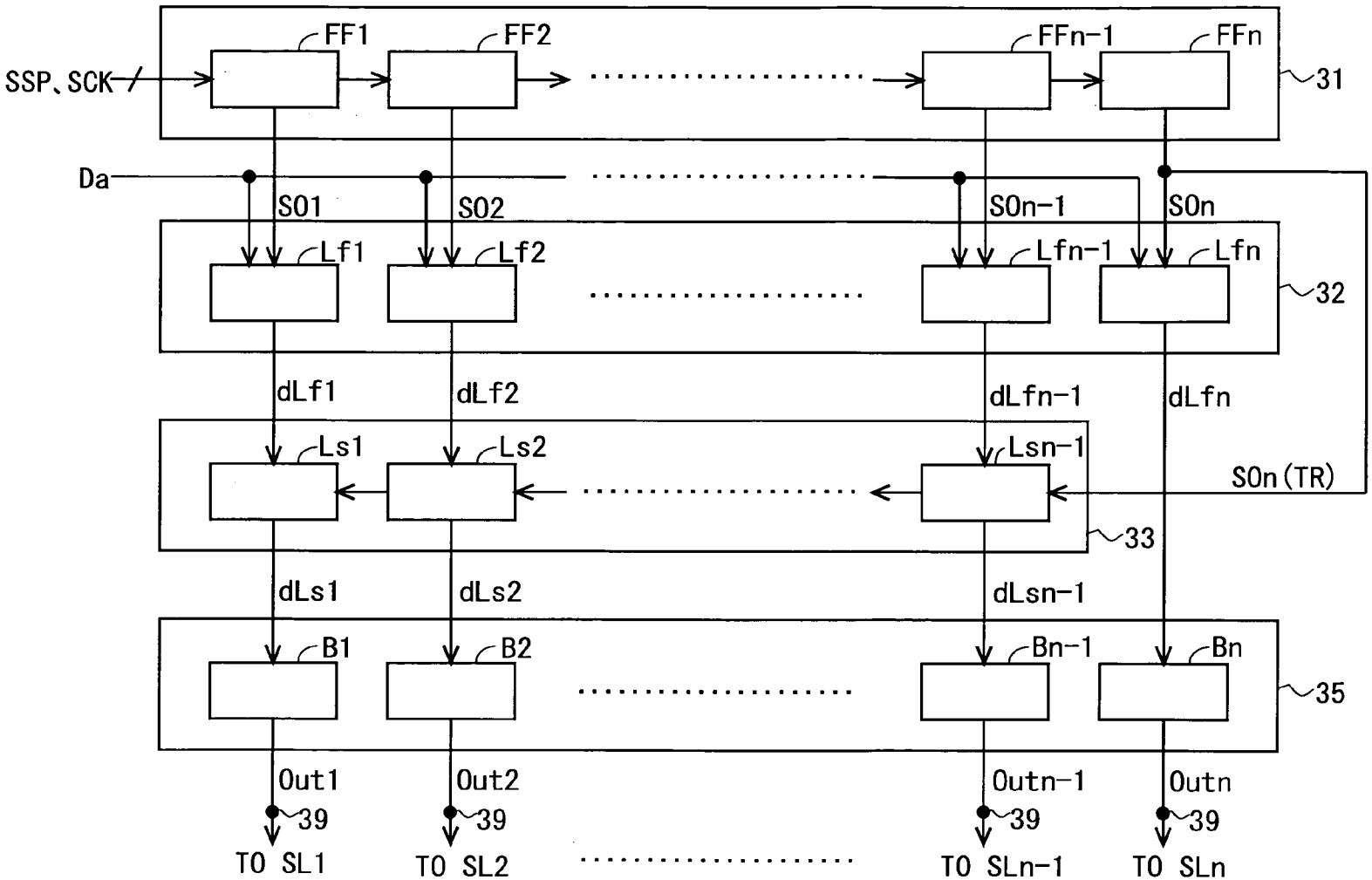
FIG. 11 is a block diagram illustrating another source driver according to the conventional art.
Figure 12:
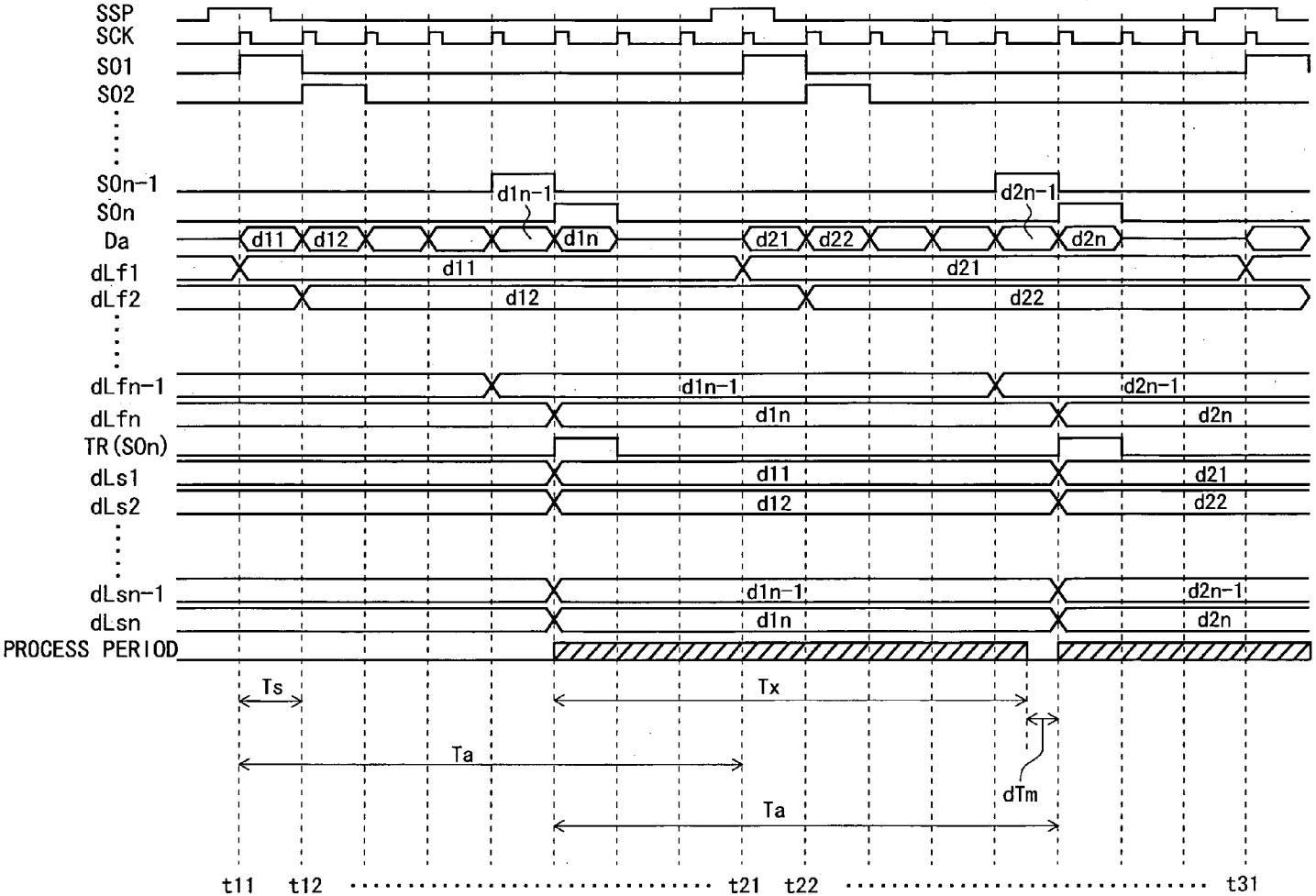
FIG. 12 is another signal waveform diagram in relation to the conventional art.

Next, the effect of circuit scale reduction according to the present invention will be described in detail by way of an example of applying the present invention to a video signal line drive circuit of a color liquid crystal display device. FIG. 8 is a block diagram partially illustrating the configuration of a source driver 300 of the color liquid crystal display device. The source driver 300 of the display device is configured based on the second variant shown in FIG. 6. The display device is of a so-called QVGA type, and the number of pixels included in each horizontal line is 320. Each pixel consists of three subpixels (red-color subpixel, green-color subpixel, and blue-color subpixel), and video signal lines SL1(R) to SL320(R), SL1(G) to SL320(G), and SL1(B) to SL320(B) are provided in association with the subpixels. Accordingly, the number of video signal lines included in the display device is 960 (320×3). Similarly, the No. 1 latch circuits, the No. 2 latch circuits, and the output circuits are provided in association with the subpixels. Image signals Da(R), Da(G) and Da(B) transmitted from the display control circuit 200 are respectively inputted to the No. 1 latch circuits associated with SL1(R) to SL320(R), the No. 1 latch circuits associated with SL1(G) to SL320(G), and the No. 1 latch circuits associated with SL1(B) to SL320(B). Sampling pulses outputted from the flip-flop circuits of the shift register 31 are inputted to three No. 1 latch circuits provided in association with the subpixels. Specifically, a sampling pulse outputted from one flip-flop circuit is inputted to three No. 1 latch circuits. In addition, the image signals Da(R), Da(G) and Da(B) each consist of six bits. Therefore, the No. 1 latch circuits and the No. 2 latch circuits each include six latches.

Next, the number of No. 2 latch circuits that can be eliminated from the No. 2 latch circuit group 33 (hereinafter, referred to as the "No. 2 latch circuit elimination number") will be described in comparison with the conventional configuration. First, the number of No. 2 latch circuits included in the No. 2 latch circuit group 33 when the color liquid crystal display device is configured in accordance with the conventional art is calculated. In the conventional configuration, the No. 2 latch circuits are provided in association with their respective video signal lines. In addition, as described above, the number of video signal lines included in the display device is 960, and therefore the number of No. 2 latch circuits included in the No. 2 latch circuit group 33 is 960.

In the present description, the No. 2 latch circuit elimination number is calculated based on the following premises. The length Ta of one horizontal scanning period is 63.5 μs (microseconds), a cycle TS (a pulse repetition cycle of the source clock signal SCK) in which sampling pulses are outputted from the shift register 31 is 159 ns (nanoseconds), wiring capacitance C of the video signal line is 100 PF (picofarads), and wiring resistance R of the video signal line is 10 kΩ. In addition, when the resistance that is to be taken into consideration includes only the wiring resistance R, the time required for charging the wiring capacitance C to 99% is 5τ. Furthermore, when output resistance of the output circuit and switch-on resistance are taken into consideration along with the wiring resistance R, the time required for charging the wiring capacitance C to 99% is five times the time required when only the above-mentioned wiring resistance R is taken into consideration. Note that the above premises are based on standards and so on. In addition, the number M of stages of the shift register is 320, and the number L of No. 1 latch circuits provided in association with the stages of the shift register is 3.

The time (state maintaining period) Tx required for charging the wiring capacitance C to 99% is calculated by the following equation (1).

$$Tx=5\tau\times5 \quad (1)$$

Thus, Tx=5×C×R×5=5×100 pF×10 kΩ×5=25 μs.

Where the number of No. 2 latch circuits included in the No. 2 latch circuit group 33 is N, a charge time Ty obtained by the present configuration is calculated by the following equation (2).

$$Ty=Ta-Ts\times(M-N/L-1) \quad (2)$$

Thus, Ty=63.5 μs−159 ns×(320−N/3−1)=63.5 μs−0.159 μs×(319−N/3).

Here, in order to establish Ty≧Tx, the number N of No. 2 latch circuits included in the No. 2 latch circuit group 33 must be set in such a manner as to satisfy the following equation (3).

$$63.5\mu s-0.159\mu s\times(319-N/3)\geqq25\mu s \quad (3)$$

Thus, N≧230.6. Therefore, 231 No. 2 latch circuits may be provided in the No. 2 latch circuit group 33.

Thus, the No. 2 latch circuit elimination number is 729 (960−231). In addition, six latches are included in a single No. 2 latch circuit as described above, and therefore the number of latches that are to be eliminated is 4274 (729×6). On the other hand, the number of switches that are elements to be added to the conventional configuration is 960. Thus, it is possible to considerably reduce the circuit scale compared to the conventional configuration.

The invention claimed is:

1. A serial-parallel conversion circuit for converting a serial signal into a parallel signal for each predetermined period, the circuit comprising:

a shift register for sequentially outputting sampling pulses to sample the serial signal;

first latch circuits provided in association with stages of the shift register so as to sample and latch the serial signal in accordance with the sampling pulses; and second latch circuits provided in association with their respective portions of the stages of the shift register so as to latch signals outputted from the first latch circuits provided in association with the stages associated with the second latch circuits, and wherein the number of stages included in the portions of the stages is less than a total number of stages of the shift register by two or more.

2. A video signal line drive circuit of a display device including a plurality of pixel formation units for forming an image to be displayed and a plurality of video signal lines for conveying a plurality of video signals representing the image to the pixel formation units, wherein the video signal line drive circuit comprises a serial-parallel conversion circuit of claim 1.

3. The serial-parallel conversion circuit according to claim 1, wherein the following equation is satisfied:

$$N\leqq(M-2)\times L,$$

where the total number of stages of the shift register is M, the number of first latch circuits associated with the stages of the shift register is L, and a total number of second latch circuits is N.

4. The serial-parallel conversion circuit according to claim 3, wherein the number of second latch circuits are set, such that a period in which signal values of signals outputted from first latch circuits not associated with the second latch circuits are values of serial signals which are in the same predetermined period is longer than a state maintaining period, which is a period in which to maintain a value of the parallel signal.

5. The serial-parallel conversion circuit according to claim 4, wherein the following equation is satisfied:

$$Tx\leqq Ta-Ts\times(M-N/L-1),$$

where the state maintaining period is Tx, a cycle in which the serial signal is converted into the parallel signal is Ta, and a cycle in which the sampling pulses are outputted from the shift register is Ts.

6. The serial-parallel conversion circuit according to claim 1, further comprising:

switching circuits for selecting whether to allow or prevent conveyance of the parallel signal to their respective output ends, which are provided at least between first latch circuits not associated with the second latch circuits and the output ends, wherein the switching circuits allow the conveyance of the parallel signal to the output ends during the state maintaining period, but prevent the conveyance of the parallel signal to the output ends during periods other than the state maintaining period.

7. The serial-parallel conversion circuit according to claim 1, further comprising:

switching circuits for selecting whether to allow or prevent conveyance of the parallel signal to their respective output ends, which are provided between the second latch circuits and the output ends and between first latch circuits not associated with the second latch circuits and the output ends, wherein the switching circuits allow the conveyance of the parallel signal to the output ends during the state maintaining period, but prevent the conveyance of the parallel signal to the output ends during periods other than the state maintaining period.

8. The serial-parallel conversion circuit according to claim 1, wherein an element constituting the serial-parallel conversion circuit is a thin-film transistor.

9. A display device comprising a plurality of pixel formation units for forming an image to be displayed, a plurality of video signal lines for conveying a plurality of video signals representing the image to the pixel formation units, and a video signal line drive circuit for driving the video signal lines, the video signal line drive circuit having a serial-parallel conversion circuit for converting a serial signal into a parallel signal for each predetermined period, wherein the serial-parallel conversion circuit includes:

a shift register for sequentially outputting sampling pulses to sample the serial signal;

first latch circuits provided in association with stages of the shift register so as to sample and latch the serial signal in accordance with the sampling pulses; and second latch circuits provided in association with their respective portions of the stages of the shift register so as to latch signals outputted from the first latch circuits provided in association with the stages associated with the second latch circuits, and wherein the number of stages included in the portions of the stages is less than a total number of stages of the shift register by two or more.

10. The display device according to claim 9, wherein the following equation is satisfied:

$$N \leqq (M-2) \times L,$$

where the total number of stages of the shift register is M, the number of first latch circuits associated with the stages of the shift register is L, and a total number of second latch circuits is N.

11. The display device according to claim 10, wherein the number of second latch circuits are set, such that a period in which signal values of signals outputted from first latch circuits not associated with the second latch circuits are values of serial signals which are in the same predetermined period is longer than a state maintaining period, which is a period in which to maintain a value of the parallel signal.

12. The display device according to claim 11, wherein the following equation is satisfied:

$$Tx \leqq Ta - Ts \times (M - N/L - 1),$$

where the state maintaining period is Tx, a cycle in which the serial signal is converted into the parallel signal is Ta, and a cycle in which the sampling pulses are outputted from the shift register is Ts.

13. The display device according to claim 9, further comprising:

switching circuits for selecting whether to allow or prevent conveyance of the parallel signal to their respective output ends, which are provided at least between first latch circuits not associated with the second latch circuits and the output ends, wherein the switching circuits allow the conveyance of the parallel signal to the output ends during the state maintaining period, but prevent the conveyance of the parallel signal to the output ends during periods other than the state maintaining period.

14. The display device according to claim 9, further comprising:

switching circuits for selecting whether to allow or prevent conveyance of the parallel signal to their respective output ends, which are provided between the second latch circuits and the output ends and between first latch circuits not associated with the second latch circuits and the output ends, wherein the switching circuits allow the conveyance of the parallel signal to the output ends during the state maintaining period, but prevent the conveyance of the parallel signal to the output ends during periods other than the state maintaining period.

15. The display device according to claim 9, wherein an element constituting the serial-parallel conversion circuit is a thin-film transistor.

16. The display device according to claim 9, wherein the display device is of an active matrix-type.

17. The display device according to claim 9, wherein the video signal line drive circuit is composed of at least an amorphous, polycrystal, or monocrystal thin-film transistor formed on an insulated substrate.

* * * * *